US006223957B1

(12) United States Patent
Hoppe

(10) Patent No.: US 6,223,957 B1
(45) Date of Patent: May 1, 2001

(54) PLUG FOR INSERTION INTO AND REMOVABLY SEALING AN ANNULUS IN A NOZZLE CONNECTED TO A CONTAINER OF EXTRUDABLE MATERIAL AND METHOD OF USE

(76) Inventor: Richard G. Hoppe, Rte. 1, Box 381, Alvin, TX (US) 77511

( * ) Notice: Subject to any disclaimer, the term of this patent is extended or adjusted under 35 U.S.C. 154(b) by 0 days.

(21) Appl. No.: 09/506,044

(22) Filed: Feb. 17, 2000

(51) Int. Cl.[7] ..... B67D 47/00
(52) U.S. Cl. ..... 222/563; 222/151
(58) Field of Search ..... 222/543, 570, 222/563, 552, 554, 151

(56) References Cited

U.S. PATENT DOCUMENTS

| | | |
|---|---|---|
| 3,433,394 | 3/1969 | Stull et al. . |
| 3,460,724 | 8/1969 | Chmela . |
| 3,520,453 | 7/1970 | Stull . |
| 3,785,539 | 1/1974 | Wetterek . |
| 3,809,275 | 5/1974 | Ek . |
| 3,973,697 | 8/1976 | Cram . |
| 4,109,820 | 8/1978 | Stifano . |
| 4,349,116 | 9/1982 | Lufnser . |
| 4,640,434 | 2/1987 | Johsen et al. . |
| 4,892,219 | 1/1990 | Smith . |
| 4,957,225 | 9/1990 | Childers . |
| 4,964,548 | 10/1990 | Kenyon . |
| 5,135,139 | 8/1992 | Krawagna . |
| 5,139,182 | 8/1992 | Appla . |
| 5,186,370 | 2/1993 | Ricketts . |
| 5,248,071 | 9/1993 | Ray . |
| 5,295,601 | 3/1994 | Bostleman . |
| 5,493,849 | 2/1996 | Itoh . |
| 5,573,127 | 11/1996 | Takahashi . |
| 5,615,807 | 4/1997 | Peng . |
| 5,692,628 | 12/1997 | Montgomery et al. . |

*Primary Examiner*—Kevin Shaver
*Assistant Examiner*—David Deal
(74) *Attorney, Agent, or Firm*—Duane, Morris & Heckscher LLP

(57) ABSTRACT

A plug to be placed in the nozzle of a container to seal the contents from leaking or exposure to air. The plug comprises a body having a shape generally symmetrically congruent with the shape of the nozzle but which is tapered to a size small enough on one end to fit into the aperture, but large enough on another end to prevent the plug from insertion completely through the nozzle. The generally conical shape of a preferred embodiment of the present invention is in a taper comparable to an end of a caulk tube nozzle.

38 Claims, 4 Drawing Sheets

PLUG FOR INSERTION INTO AND REMOVABLY SEALING AN ANNULUS IN A NOZZLE CONNECTED TO A CONTAINER OF EXTRUDABLE MATERIAL AND METHOD OF USE

TECHNICAL FIELD

The present invention relates generally to closures for sealing nozzles and more particularly to an improved plug useful for removably sealing a container having extractable material that the user does not want to leak out or be exposed to the atmosphere. More specifically, the present invention relates to a closure plug for a container of caulk such as a tube of caulk.

BACKGROUND ART

At the start of a caulking or other similar operation, a nozzle of a container of extrudable material, the nozzle having an annulus or passageway there through, is typically cut to a create a desired aperture for passing extrudable material from the container through the nozzle. In typical situations, the extrudable material is kept within the container and protected from exposure to the atmosphere by an inner seal such as a foil seal. After the seal is punctured, a user may then apply the extrudable material from the container. When the user has finished applying the extrudable material, generally, an unplugged nozzle of a tube or container of caulk or like substance will harden from exposure to the atmosphere. By way of example and not limitation, the description of the present invention will be given herein in relation to a plug for a container such as container of caulk. However, those of ordinary skill in the art will be able to see that the invention may be used for a wide variety of functions and containers.

Accordingly, most containers are configured such that subsequent cuttings of the nozzle are required for subsequent use. Unfortunately, cutting away more of the nozzle changes the size of the nozzle's dispensing aperture and accordingly affects the size of the bead of extrudable material expelled from the container. This is a large problem in the art field.

Attempts have been made in the art field to solve this problem with varying degrees of success. Plugs similar to the present invention found in the prior art require the tube manufacturer to modify or customize the general shape and construction of the standard nozzles in order to obtain the objective of reducing the amount of air in contact with the extrudable material. Further, the prior art plugs have not solved the problem of preventing air from reacting with the contents of a container.

One example is described in U.S. Pat. No. 4,213,546 that describes a caulking cap that fits over the caulking gun or caulking tube nozzle. Additionally, the invention has an attachment on the side where the cap may be hung on the handle of the caulking gun. '546 provides a cover seal, but the cover seal may still trap air in the caulk and facilitate the drying of the tube. Another example in the art field is U.S. Pat. No. 4,964,548. This patent describes a two piece sealing device for a threaded connection on the end of a tube. However, the patent is designed to work only on the threaded connectors specifically manufactured. Without threads the device will not work. The '548 patent does not disclose a universal plug.

Neither of these teach nor suggest using a plug as a means to support a container from a shelf, workbench, or other structure.

Accordingly, it is an object of the present invention to provide an improved plug for closing the end of a container of extrudable material and method of use for the same.

SUMMARY OF THE INVENTION

The present invention comprises an improved plug for insertion into and removably sealing an aperture in a nozzle connected to a container of an extrudable material, the nozzle comprising a passageway and an aperture exposing at least a portion of the passageway; the plug comprising a body having a first end and a second end; the first end sized not larger than the aperture in the nozzle and not larger than the annulus; and the second end sized larger than the aperture in the nozzle. A spike useful for puncturing a seal intermediate the nozzle and the container may also be provided.

Because of a preferred embodiment's generally tapered shape, the present invention's plug is adaptable to existing nozzle designs without a need to modify the nozzle such as by requiring threads on or in the nozzle. A preferred embodiment's generally conical shape helps attain an airtight seal in the passageway and facilitates removal as desired from the nozzle when extrudable material is to be dispensed.

An improved method for plugging the container using the present invention's improved plug is also provided.

This summary is not intended to be a limitation with respect to the features of the invention as claimed, and this and other objects can be more readily observed and understood in the detailed description of the preferred embodiment and the claims.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

GENERAL DESCRIPTION AND PREFERRED MODE FOR CARRYING OUT THE INVENTION

Figure 1:
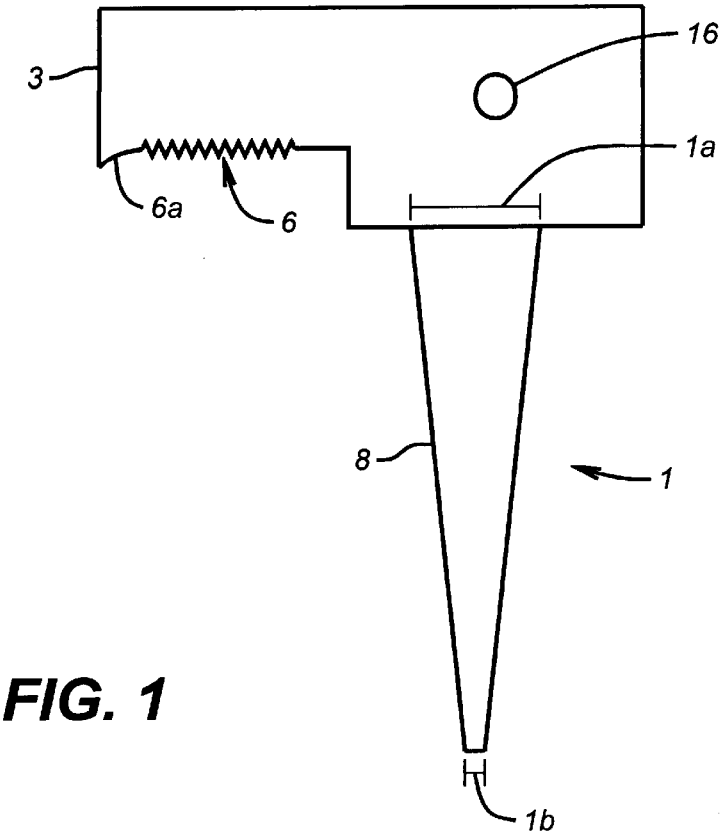
FIG. 1 and FIG. 1*a* are cross section views of the present invention and of a container with a nozzle for plugging.

Referring now to FIG. 1, a cross sectional view of the general orientation of the body of a preferred embodiment of the present invention, in a preferred embodiment body 1 has a generally conical profile and is tapered from second plug end 1*a* to first insertion end 1*b* where second plug end 1*a* is larger than insertion end 1*b*. It is critical that insertion end 1*b* is also smaller than nozzle aperture 7 to be plugged.

In a preferred embodiment, body 1 comprises a metal, by way of example and not limitation such as steel, aluminum, copper, lead, tin, or alloys thereof. However, body 1 may be constructed of any material common in the art such as a resin like polyvinyl chloride, plastic such as high density polypropylene, or any combination thereof.

In a preferred embodiment, body 1 comprises a generally smooth outer wall 8. In alternate embodiments, outer wall 8 of body 1 may comprise discontinuities such as thread 10 (shown in FIG. 2), steps 11 (shown in FIG. 3) or ridges 12 (shown in FIG. 4) running along some portion of outer wall 8 or all the way from insertion end 1*b* to second plug end 1*a* along outer wall 8. Use of discontinuities such as treads 10; steps 11 or ridges 12 allows a user to apply more force when inserting body 1 into aperture 7, providing an insertion interference fit and a greater sealing effect.

Additionally, handle 3 may be attached to or part of body 1 to facilitate storage such as on a shelf. Handle 3 and body 1 may be separate pieces and may be connected by connector means, all of which are commonly known to those skilled in the fabrication arts, such as an adhesive like glue, nails, screws, rivets, welds, or other methods of or combinations of methods of attachment. A preferred embodiment of the present invention envisions body 1 being formed of metal and handle 3 of wood, where body 1 is attached to handle 3 by a glue capable of bonding metal and wood.

In an alternative preferred embodiment, body 1 and handle 3 may also comprise a single body 1 and be formed by an appropriate means, by way of example and not limitation including extrusion, molding, casting, or other methods familiar to those skilled in the fabrication arts, such as from high density polypropylene.

Accordingly, handle 3 may be fashioned in any shape consistent with the teachings of the present invention. In a preferred embodiment, handle 3 is at least as wide as the widest portion of body 1, which in the preferred embodiment is the diameter of second plug end 1*b*. However, the present invention may use any size handle 3.

In a preferred embodiment, handle 3 extends radially beyond body 1 and may be used to hang container 5 of extrudable material into which body 1 has been inserted from a surface, such as a workbench, shelf or other structure. Handle 3 is hung on a surface such that a roughened edge 6 may increase the coefficient of friction between the surface and handle 3. This increased friction allows a user to position an embodiment of the present invention is such a way, e.g. balance, that it will not fall from the surface, such as a workbench or shelf edge or other suitable structure. Further, handle 3 may comprise tip 6*a* such that tip 6*a* may be placed in an indentation on the surface for support during storage, e.g. a groove, notch or slot in the surface.

Roughened edge 6 and tip 6*a* may be contiguous portions of handle 3 or may be separate pieces that are attached to handle 3. In a preferred embodiment, roughened edge 6 and tip 6*a* are formed from handle 3 such that handle 3, roughened edge 6, and tip 6*a* are one piece. Accordingly, roughened edge 6 may be any shape that acts to interrupt a smooth underside of handle 3 thus providing a surface upon which to hang an embodiment of the present invention with container 5 attached by an embodiment of the present invention inserted into nozzle 4.

Figure 1A:
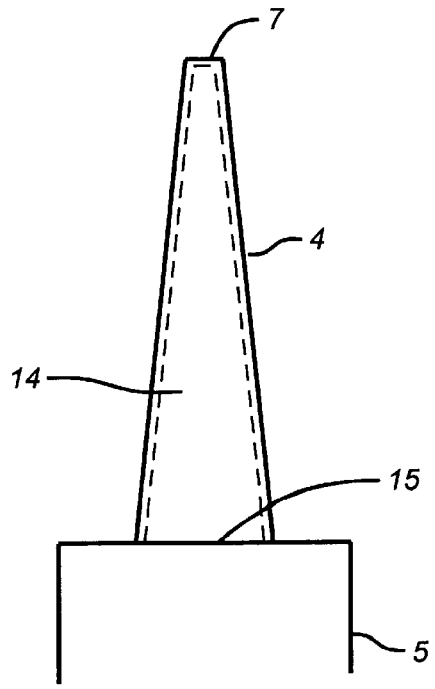

FIG. 1*a* is a cross-sectional view of container 5 with nozzle 4, aperture 7 and annulus or passageway 14. The embodiment of container 5 in FIG. 1*a* is illustrative of a general shape nozzle 4 may have. It may be observed that nozzle 4 may be hollow, as in FIG. 1*a,* such that aperture 7 is not greater in diameter than annulus 14 in nozzle 4.

In a preferred embodiment, body 1 is symmetrically congruent to the shape of nozzle 4 on container 5 such as, but not limited to, right conical, pyramidal or cylindrical. The shape of body 1 is such that insertion end 1*b* of body 1 is always smaller than any aperture 7 of nozzle 4 and at least one portion of body 1 is equivalent in diameter to aperture 7 along insertion end 1*b* and second plug end 1*a* such that body 1 may always be inserted into and be in sealing contact with aperture 7 of nozzle 4.

Figure 2A:
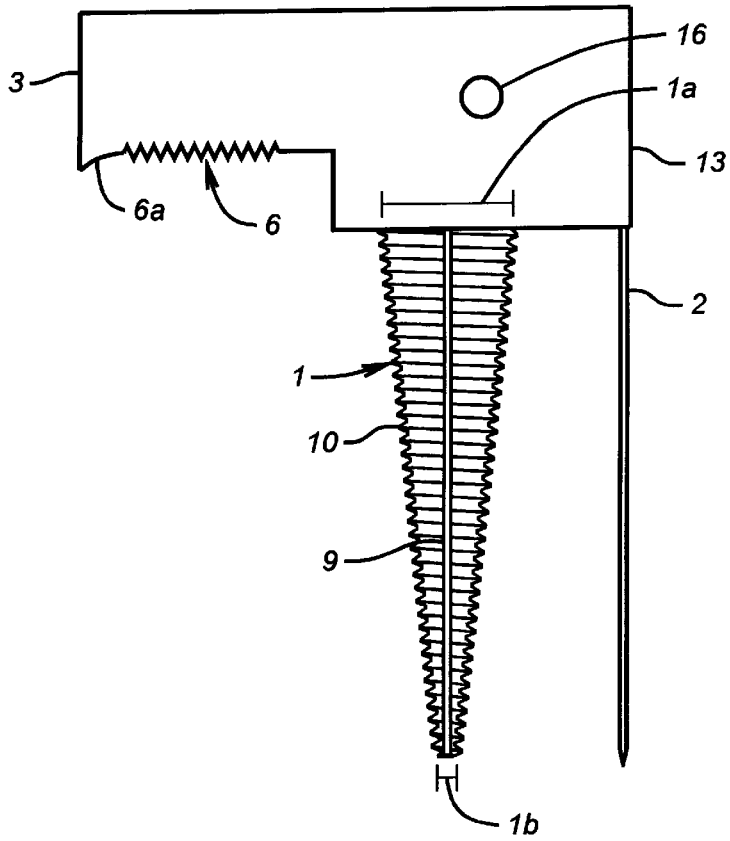
FIG. 2*a* is a side view of a handle showing a receptacle for a spike.
Figure 2A:
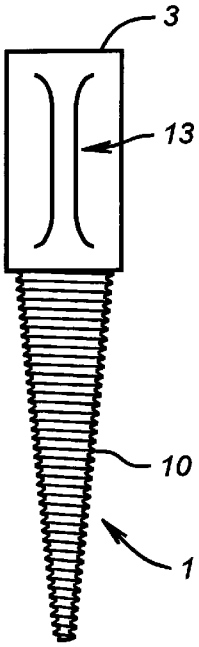
Figure 2:
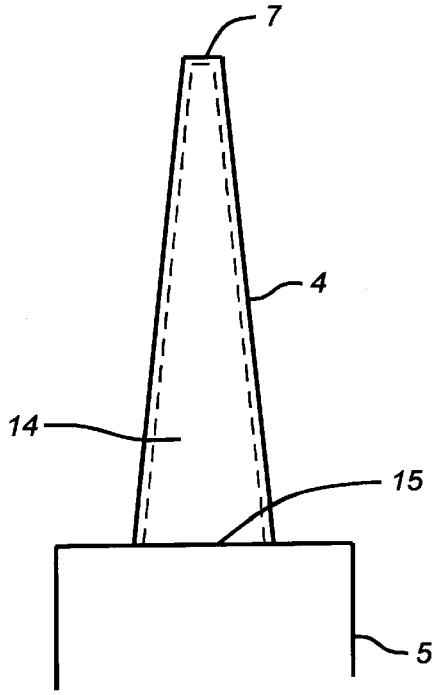
FIG. 2 is an illustration of one embodiment of the present invention with a thread on the plug in the environment of a container and nozzle.

Referring now to FIG. 2, an alternate embodiment of the present invention may utilize spike 2 comprising a sufficiently rigid material, where spike 2 has a length sufficient to penetrate seal 15 intermediate nozzle 4 and the contents of container 5, such as by way of example and not limitation a 16 penney nail of around 3½ inches in length. Spike 2 may be driven from a top end of handle 3 through insertion end 1*b*. Further, secure spike 2 may be secured within receptacle 13. However, attachment of spike 2 may be by any means common in the art, such as adhesives or clamps or friction fit. Furthermore, spike 2 may be an integral part of handle 3, body 1, or a combination thereof. Additionally, spike 2 may be constructed of any material resilient enough to puncture seal 15, such as a metal, plastic or other similar material.

In a preferred embodiment, body 1 has thread 10 extending from about second plug end 1*a* to about insertion end 1*b*. Thread 10, which may be continuous, may be utilized to obtain an insertion interference fit into nozzle 4 to better seal container 5. In a preferred embodiment, a user may twist body 1 into nozzle 4 such that the insertion interference fit is of a sufficient frictional force to support container 5 in storage. Thread 10 may aid in providing friction for an insertion interference fit.

Opening 16 may be present through handle 3. Opening 16 may be a simple hole or other passage through handle 3. Opening 16 may be utilized by a user to suspend the present invention such as by placing a peg or post through opening 16, the peg or post being secured on a wall or other structure. Further, a sharp edge (not shown in the figures) may be incorporated about handle 3 such that a user may utilize the sharp edge to cut, shear or remove the tip of a nozzle. In a preferred embodiment, the sharp edge may be disposed about opening 16 such that the user may place an end of nozzle 4 into opening 16 and cut a desired portion. Alternatively, one or more sharp edges may be present to provide a sliding, cutting edge of a desired shape.

Peel groove 9 may be disposed substantially longitudinally along body 1, and is situated such that a user may more easily remove aged and/or hardened extrudable material from body 1. In a preferred embodiment, after the improved plug of the present invention is removed from nozzle 4, hardened extrudable material may remain on body 1. In a preferred embodiment, a user may accomplish removal of the hardened extrudable material by running a knife blade point or other cutting edge down peel groove 9 to cut away material and allow the remainder of the material to be more easily removed from body 1.

FIG. 2*a* is a view of an embodiment of the present invention across a side of handle 3. In a preferred embodiment, one or more receptacles 13 are disposed along an edge of handle 3 such that a user may removably secure spike 2 onto receptacle 13. Receptacle 13 may be formed by any manner in the art capable of removably securing spike 2 such as an aperture or indentation.

Figure 3:
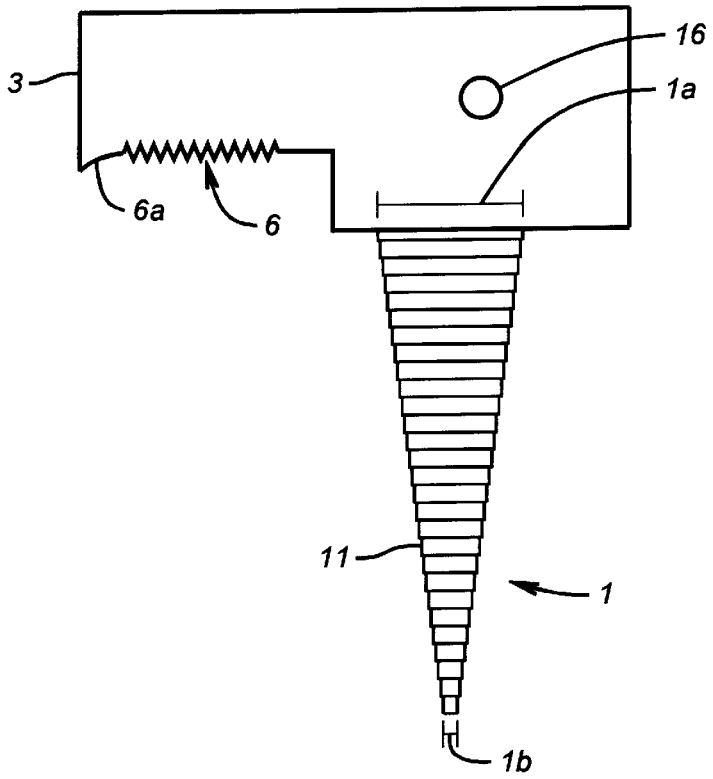
FIG. 3 is an illustration of an embodiment of the present invention with steps on the plug.

Referring now to FIG. 3, a view of an embodiment of the present invention in which body 1 has steps 11 along second plug end 1*a* and insertion end 1*b,* body 1 may have one or more steps 11 disposed about outer wall 8. The number of steps 11 may vary according to the application sought for the present invention. Steps 11 may aid in providing friction for an insertion interference fit.

Figure 4:
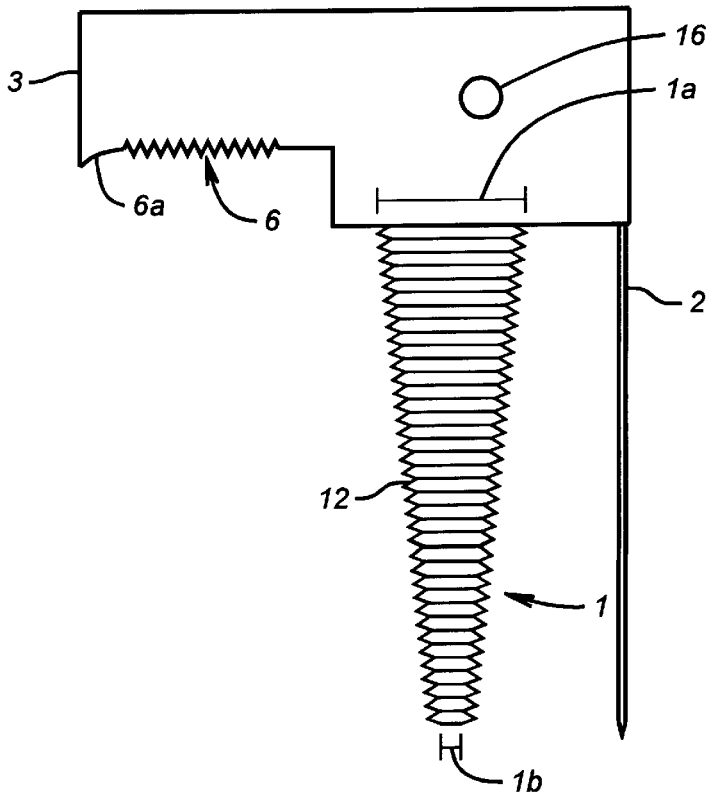
FIG. 4 is an illustration of an embodiment of the present invention with ridges on the plug.

Referring now to FIG. 4, a view of an embodiment of the present invention in which body 1 has ridges 12 along second plug end 1*a* and insertion end 1*b*, body 1 may further comprise one or more ridges 12 disposed about outer wall 8. Ridges 12 may also aid in providing friction for an insertion interference fit.

In the operation of the preferred embodiment, referring back to FIG. 2, container 5 and nozzle 4 as represented are typical of containers such as tubular containers of caulk. After nozzle 4 has been tapered or otherwise cut to reveal annulus 14 as desired, body 1 may be inserted into nozzle 4, sealing nozzle 4 from the atmosphere. Insertion end 1*b* of body 1 is smaller than the smallest aperture 7 on nozzle 4 and second plug end 1*a* of body 1 is larger than aperture 7 of nozzle 4. Accordingly, when insertion end 1*b* is inserted into nozzle 4 a seal may be formed such that the likelihood of extrudable material within container 5 drying, hardening, leaking, or being ruined will be lessened.

As opposed to the prior art, in the preferred embodiment body 1 is generally the same shape of nozzle 4, but inverted to be complimentary to nozzle 4. Accordingly, when body 1 is inserted into nozzle 4, the orientation of body 1 is such that the smaller end of nozzle 4 and the smaller end of body 1 will be aligned. In this manner, the present invention may be used with existing nozzles 4 without a need to customize or otherwise modify new and existing manufactured tube nozzles 4.

Figure 5:
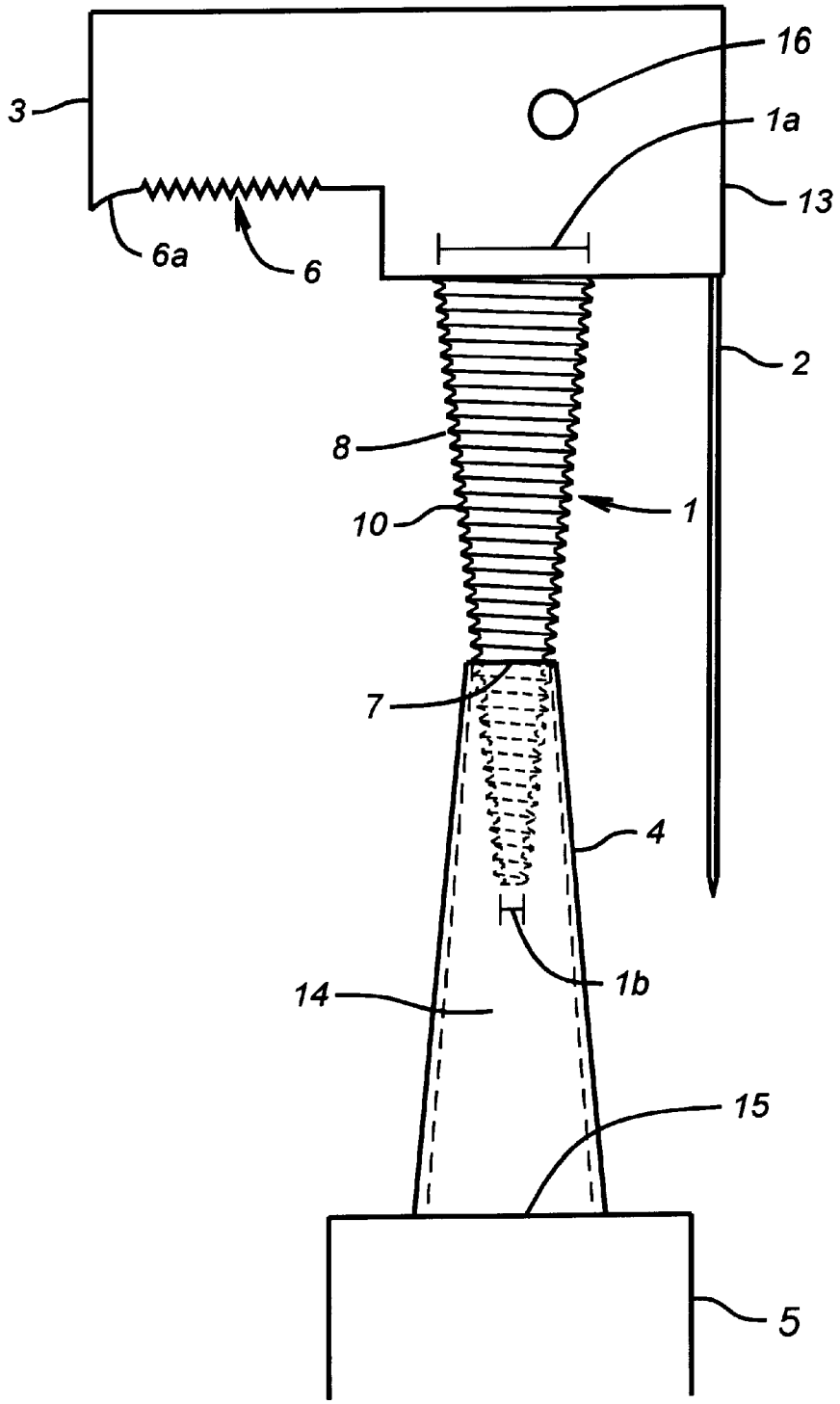
FIG. 5 is an illustration of an embodiment of the invention inserted into a nozzle of a container.

Referring now to FIG. 5, a view of an embodiment of the present invention in which body 1 is inserted into nozzle 4 of container 5, aperture 7 of nozzle 4 is generally trimmed to a size aperture and a desired angle of cut prior to use of body 1. For additional embodiments comprising one or more spikes 2, spike 2 may be used to clear, puncture, or remove a pre-existing container closure on nozzle 4, to initially puncture seal 15 intermediate nozzle 4 and container 5, or any combination thereof.

Body 1 is inserted into nozzle 4 by aligning body 1 and nozzle 4 such that insertion end 1*b* is adjacent to aperture 7. If aperture 7 is blocked, a user may puncture, remove, or clear the blockage with spike 2. After a user determines aperture 7 is clear, the user may insert body 1 into nozzle 4 at insertion end 1*b*. The user should, but is not required to, continue inserting body 1 until body 1 is in contact with nozzle 4 circumferentially near second plug end 1*a*. Body 1 may be twisted to better seal body 1 against nozzle 4. Accordingly, in a preferred embodiment, body 1 is secured into annulus 14 by an insertion interference fit.

If handle 3 is present, container 5 which has been plugged with body 1 may be hung by placing handle 3 on a surface such that roughened edge 6 is in contact with the surface such as a shelf or workstation bench. In a preferred embodiment, roughened edge 6 may rest along a shelf edge in storage. Additionally, tip 6*a* may be arranged in an indentation, notch or other recess such that tip 6*a* may further secure the plug and container. In a further embodiment, handle 3 may be suspended from a structure such as a post or peg through opening 16.

It will be readily apparent to those of skill in the art that this improved plug may be easily inserted to and stored with container 5. Additionally, those of skill in the art will see the enhanced value of the invention as it operates to save the extrudable material in containers 5. It will also be seen that this invention may be used in nozzles 4 or aperture 7 that need plugging, blocking or the like.

In view of the above disclosure, it will be seen that the present invention has attained many advantages over the prior art.

It may be seen from the preceding description that an improved plug for insertion into and removably sealing an aperture in a nozzle connected to a container of an extrudable material has been provided.

It is noted that the embodiment of the improved plug for insertion into and removably sealing an aperture in a nozzle connected to a container of an extrudable material described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. An improved plug for insertion into and removably sealing an aperture in a nozzle connected to a container of an extractable material, the nozzle having a predetermined shape comprising a passageway and the aperture exposing at least a portion of the passageway, the plug comprising:

a body having a first end and a second end, the body having a shape substantially symmetrical to the shape of the nozzle along at least a portion of the body intermediate the first end and the second end; and a peel groove disposed as a substantially longitudinal channel intermediate the first end and the second end of the body;

wherein the first end is sized not larger than the passageway; and the second end is sized larger than a largest circumference of the nozzle;

whereby a portion of a circumference of the body is of equivalent size to a circumference of the aperture such that the plug may be inserted into and be in sealing contact with the aperture.

2. The improved plug of claim 1 further comprising at least one thread disposed about an exterior of the body intermediate the first end and the second end.

3. The improved plug of claim 1 further comprising at least one discontinuity disposed about an exterior of the body intermediate the first end and the second end.

4. The improved plug of claim 1 wherein the body is substantially conical.

5. The improved plug of claim 1 wherein the body is substantially pyramidal.

6. The improved plug of claim 1 wherein the body is substantially cylindrical.

7. The improved plug of claim 1 wherein the body comprises a plastic.

8. The improved plug of claim 1 further comprising a handle disposed about the second end wherein at least a portion of the handle extends radially from the second end.

9. The improved plug of claim 8 wherein the handle further comprises a lip disposed at a distal end of the handle, the lip extending generally downward from the handle generally parallel to the body.

10. The improved plug of claim 8 wherein at least a portion of a bottom portion of the handle has a roughened surface.

11. An improved plug for insertion into and removably sealing an aperture in a nozzle connected to a container of an extractable material, the nozzle having a predetermined shape comprising a passageway and the aperture exposing at least a portion of the passageway, the plug comprising:

a body having a first end and a second end, the body having a shape substantially symmetrical to the shape of the nozzle along at least a portion of the body intermediate the first end and the second end;

a handle disposed about the second end wherein at least a portion of the handle extends radially from the second end; and a lip disposed at a distal end of the handle, the lip extending generally downward from the distal end of the handle generally parallel to the body;

wherein the first end is sized not larger than the passageway; and the second end is sized larger than a largest circumference of the nozzle;

whereby a portion of a circumference of the body is of equivalent size to a circumference of the aperture such that the plug may always be inserted into and be in sealing contact with the aperture.

12. The improved plug of claim 11 wherein the handle is integral with the body.

13. The improved plug of claim 11 further comprising at least one discontinuity disposed about an exterior of the body intermediate the first end and the second end.

14. The improved plug of claim 11 wherein the body has a shape selected from the shapes consisting of conical, cylindrical, and pyramidal shapes.

15. The improved plug of claim 11 wherein the handle further comprises a channel extending completely through the handle.

16. The improved plug of claim 11 further comprising a sharp edge disposed about the handle adapted to cut the nozzle to create the aperture.

17. The improved plug of claim 11 wherein the body comprises a plastic.

18. The improved plug of claim 11 wherein the handle comprises a plastic.

19. The improved plug of claim 11 wherein the handle comprises a metal.

20. The improved plug of claim 11 wherein at least a portion of a bottom portion of the handle has a roughened surface.

21. An improved plug for insertion into and removably sealing an aperture in a nozzle connected to a container of an extractable material, the nozzle the nozzle having a predetermined shape comprising a passageway and the aperture exposing at least a portion of the passageway, the plug comprising:

a body having a first end and a second end, the body having a shape substantially symmetrical to the shape of the nozzle along at least a portion of the body intermediate the first end and the second end;

a spike, suitable for puncturing a seal intermediate the nozzle and the container, disposed about the body; and a receptacle adapted to receive the spike, the receptacle disposed about the body;

wherein the first end is sized not larger than the passageway; and the second end is sized larger than a largest circumference of the nozzle;

whereby a portion of a circumference of the body is of equivalent size to a circumference of the aperture such that the plug may always be inserted into and be in sealing contact with the aperture.

22. The improved plug of claim 21 wherein at least one portion of the spike extends from at least one end of the body.

23. The improved plug of claim 21 wherein the spike comprises a metal.

24. The improved plug of claim 21 wherein the spike comprises a plastic.

25. The improved plug of claim 21 further comprising a handle disposed about the second end wherein the receptacle is disposed about an edge of the handle.

26. The improved plug of claim 21 further comprising at least one thread disposed about an exterior of the body intermediate the first end and the second end.

27. The improved plug of claim 21 further comprising at least one discontinuity disposed about an exterior of the body intermediate the first end and the second end.

28. The improved plug of claim 21 wherein the body is substantially conical.

29. The improved plug of claim 21 wherein the body is substantially pyramidal.

30. The improved plug of claim 21 wherein the body is substantially cylindrical.

31. The improved plug of claim 21 wherein the body comprises a plastic.

32. The improved plug of claim 21 further comprising a handle disposed about the second end wherein at least a portion of the handle extends radially from the second end.

33. The improved plug of claim 32 wherein the handle further comprises a lip disposed at a distal end of the handle, the lip extending generally downward from the handle generally parallel to the body.

34. The improved plug of claim 32 wherein at least a portion of a bottom portion of the handle has a roughened surface.

35. The improved plug of claim 21 further comprising a peel groove disposed as a substantially longitudinal channel intermediate the first end and the second end of the body.

36. An improved method for plugging a container with a plug, the container having a nozzle; the nozzle having a predetermined shape and a passageway communicatively connected to an interior of the container and adapted for allowing passage of extractable material from within the container through the passageway; the plug having a shape substantially symmetrical to the passageway and a body having a larger end and a smaller end; and a handle disposed about the second end wherein at least a portion of the handle extends radially from the second end, the handle further comprising a lip disposed at a distal end of the handle and extending generally downward from the distal end of the handle generally parallel to the body; the method comprising:

removing at least a portion of the nozzle creating an aperture in the nozzle whereby at least a portion of the passageway is exposed;

inserting the smaller end of the plug through the aperture into the passageway until the plug is in circumferential contact with the nozzle about the aperture, sealing the aperture;

suspending the container from a surface by placing the handle onto the surface after inserting the plug into the container; and engaging the lip into a channel in the surface onto which the container is suspended.

37. An improved method for plugging a container with a plug, the container having a nozzle; the nozzle having a predetermined shape and a passageway communicatively connected to an interior of the container and adapted for allowing passage of extractable material from within the container through the passageway; the plug having a shape substantially symmetrical to the passageway and a body having a larger end and a smaller end; and a spike disposed about the body; the method comprising:

removing at least a portion of the nozzle creating an aperture whereby at least a portion of the passageway is exposed;

removing the spike from about the body;

puncturing a seal intermediate the nozzle and the container with the spike;

inserting the smaller end of the plug through the aperture into the passageway until the plug is in circumferential contact with the nozzle about the aperture, sealing the aperture;

disposing the spike back about the body; and removing the plug when it is desired to pass extractable material through the passageway.

38. An improved method for unplugging a container with a plug, the container having a nozzle; the nozzle having a predetermined shape and a passageway communicatively connected to an interior of the container and adapted for allowing passage of extractable material from within the container through the passageway; the plug having a shape substantially symmetrical to the passageway and a body having a larger end, a smaller end, and a peel groove disposed as a substantially longitudinal channel intermediate the first end and the second end, the method comprising:

removing the plug from the passageway;

cutting extractable material that has adhered to the plug by inserting an edge of an object into the peel grove; and prying the extractable material away from a surface of the plug, using the extractable material cut at the peel groove.

* * * * *